US009494298B2

(12) United States Patent
Shen

(10) Patent No.: US 9,494,298 B2
(45) Date of Patent: Nov. 15, 2016

(54) BEAM COLLIMATED LIGHT EMITTING MODULE WITH LIGHT COLOR MIXED CHAMBER

(71) Applicant: EDISON OPTO CORPORATION, New Taipei (TW)

(72) Inventor: Chien-Yu Shen, New Taipei (TW)

(73) Assignee: EDISON OPTO CORPORATION (TW)

( * ) Notice: Subject to any disclaimer, the term of this patent is extended or adjusted under 35 U.S.C. 154(b) by 303 days.

(21) Appl. No.: 14/263,830

(22) Filed: Apr. 28, 2014

(65) Prior Publication Data

US 2015/0204516 A1 Jul. 23, 2015

(30) Foreign Application Priority Data

Jan. 22, 2014 (TW) ..... 103102321 A

(51) Int. Cl.

| | |
|---|---|
| ***F21V 7/00*** | (2006.01) |
| ***F21V 13/04*** | (2006.01) |
| ***F21V 5/04*** | (2006.01) |
| *F21Y 101/00* | (2016.01) |

(52) U.S. Cl.

CPC ..... *F21V 13/04* (2013.01); *F21V 5/04* (2013.01); *F21V 7/0091* (2013.01); *F21Y 2101/00* (2013.01); *F21Y 2113/17* (2016.08); *F21Y 2115/10* (2016.08)

(58) Field of Classification Search

CPC ..... F21V 13/04; F21V 5/04; F21V 7/0091; F21Y 2101/02; F21Y 2113/17; F21Y 2115/10; F21Y 2101/00

USPC ..... 362/309, 311.02, 235, 249.02

See application file for complete search history.

(56) References Cited

U.S. PATENT DOCUMENTS

| | | | | |
|---|---|---|---|---|
| 7,254,309 | B1 | 8/2007 | Chou et al. | 385/146 |
| 7,347,590 | B2 | 3/2008 | Lee et al. | 362/327 |
| 8,820,951 | B2 | 9/2014 | Yriberri et al. | 362/84 |
| 8,876,311 | B2 * | 11/2014 | Yokotani | F21V 3/0445 362/235 |
| 2013/0100679 | A1 | 4/2013 | Lin | 362/327 |

FOREIGN PATENT DOCUMENTS

| | | | |
|---|---|---|---|
| TW | 201329399 | 7/2013 | F21V 3/02 |
| TW | 201344109 | 11/2013 | F21V 9/00 |

* cited by examiner

*Primary Examiner* — Karabi Guharay
*Assistant Examiner* — Jessica M Apenteng
(74) *Attorney, Agent, or Firm* — Hayes Soloway P.C.

(57) ABSTRACT

A beam collimated light emitting module with a light color mixed chamber includes a light holder, a light source assembly located on the light holder, an optical lens covering the light source assembly, and a reflector. The optical lens includes a first light exit surface, a light entrance surface, and a second light exit surface. The first light exit surface has a round-shaped concave surface formed by recessing the first light exit surface, and the aspheric curvature of the concave surface is gradually decreased in an outward direction away from the center of the optical lens. The reflector surrounds the optical lens. When the light source assembly emits light, the bluish white light and the yellowish white light of the light source assembly are refracted by the concave surface, and next the bluish white light and the yellowish white light are reflected by the reflector.

9 Claims, 3 Drawing Sheets

BEAM COLLIMATED LIGHT EMITTING MODULE WITH LIGHT COLOR MIXED CHAMBER

RELATED APPLICATIONS

This application claims priority to Taiwanese Application Ser. No. 103102321, filed Jan. 22, 2014, which is herein incorporated by reference.

BACKGROUND

Field of Invention

The present invention relates to a light emitting module. More particularly, the present invention relates to a beam collimated light emitting module with a light color mixed chamber.

Description of Related Art

Lighting devices are indispensable tools in our daily lives. Conventional lighting devices usually use light bulbs or lamps as the light sources. Fluorescent tubes, incandescent bulbs, and halogen light bulbs are most frequently used among these light bulbs or lamps but are not energy economic. Therefore, lighting devices including light-emitting diodes (LED) as light sources have become more and more popular in recent years. Compared with the incandescent bulbs, LED light sources have the advantages such as long lifespan, low energy consumption, good shock resistance, and high brightness. Moreover, LED light source may be manufactured by a blue light emitting chip covered by yellow phosphor powders. When the blue light emitting chip emits light, a blue light enters and excites the yellow phosphor powders, such that the center area of the LED light source with high-density chips is apt to emit a bluish white light, and the surrounding area of the LED light source with low-density chips tend to emit a yellowish white light. Such phenomenon is more obviously observed in the type of integrated packaging LEDs.

A conventional lighting device utilizing a LED as a light source, e.g., a flashlight, a streetlight, or a car lamp, may be composed of a light holder and a light source, and may optionally include a reflector or a lens. If the lighting device is composed of the light holder, the light source, and the reflector, although the light of the light source can be reflected by the reflector to improve the beam collimation of the lighting device, the phenomenon for the center area of the LED light source emitting the bluish white light and the surrounding area of the LED light source emitting the yellowish white light still exists and reduces the uniformity of the light color. Furthermore, If the lighting device is composed of the light holder, the light source, and the lens, although the micro structure of the lens can be used to scatter the central bluish white light and the surrounding yellowish white light to improve the uniformity of the light color, the light of the lighting device is therefore diverged due to the scattering of the light. As a result, the beam collimation of the lighting device may be degraded.

It is difficult to simultaneously improve the uniformity of the light color and the beam collimation for the conventional lighting device. As such, the optical performance of the lighting device is limited and the consumers' requirement is unsatisfied.

SUMMARY

An aspect of the present invention is to provide a beam collimated light emitting module with a light color mixed chamber.

According to an embodiment of the present invention, a beam collimated light emitting module with a light color mixed chamber includes a light holder, a light source assembly, an optical lens, and a reflector. The light source assembly is located on the light holder. The optical lens covers the light source assembly. The optical lens includes a first light exit surface, a light entrance surface, and a second light exit surface. A round-shaped concave surface is formed by recessing the first light exit surface. An aspheric curvature of the concave surface is gradually decreased in an outward direction away from the center of the optical lens. A round-shaped accommodating space is formed by recessing the light entrance surface for accommodating the light source assembly. The second light exit surface is a side surface located between the first light exit surface and the light entrance surface. An end of the side surface is connected to the first light exit surface, and another end of the side surface is connected to the light entrance surface. The reflector surrounds the optical lens. The reflector is a hollow structure having a first opening and a second opening. The caliber of the first opening is greater than the caliber of the second opening. The optical lens passes through the second opening of the reflector. When the light source assembly emits light, the light source assembly emits a first color light and a second color light surrounding the first color light, the first and second color lights are refracted by the concave surface, such that the first and second color lights are mixed at a first time. Thereafter, the second color light refracted by the concave surface is reflected by the reflector, such that the second color light reflected by the reflector and the first color light refracted by the concave surface are mixed at a second time or plural times.

In one embodiment of the present invention, the concave surface has a first curved surface with a first aspheric curvature and a second curved surface with a second aspheric curvature. An end of the first curved surface is connected to an end of the second curved surface. The first and second aspheric curvatures are gradually decreased in an outward direction away from the center of the optical lens.

In one embodiment of the present invention, the light source assembly is a light emitting diode or an organic light emitting diode.

In one embodiment of the present invention, the first color light is a bluish white light, and the second color light is a yellowish white light.

In one embodiment of the present invention, a first time light-mixed position of the first and second color lights is in the optical lens.

In one embodiment of the present invention, a second time light-mixed position of the first and second color lights is between the optical lens and the reflector.

In one embodiment of the present invention, the aspheric curvature of the concave surface refracting the first color light is greater than the aspheric curvature of the concave surface refracting the second color light.

In one embodiment of the present invention, the concave surface of the optical lens has an end point located at the axis of the optical lens and facing the light source assembly. A gap is between the end point and the light source assembly.

In one embodiment of the present invention, the light entrance surface is recessed toward the first light exit surface, and the first light exit surface is recessed toward the light entrance surface.

In one embodiment of the present invention, the first color light refracted by the concave surface is reflected by a first reflecting position of the reflector. The second color light refracted by the concave surface is reflected by a second reflecting position of the reflector. A distance between the first reflecting position and the axis of the optical lens is greater than a distance between the second reflecting position and the axis of the optical lens.

In the aforementioned embodiments of the present invention, since the concave surface has the aspheric curvature that is gradually decreased in the outward direction away from the center of the optical lens, when the light source assembly emits light, the first color light (e.g., a bluish white light) and the second color light (e.g., a yellowish white light) emitted by the light source assembly may be refracted to the reflector by the concave surface, such that the first and second color lights may be mixed at the first time. Thereafter, the second color light refracted by the concave surface may be reflected by the reflector, such that the second color light reflected by the reflector and the first color light refracted by the concave surface are mixed at the second time. That is to say, the light emitting module of the present invention utilizes the collocation design of the optical lens and the reflector to mix the first and second color lights at plural times in the light emitting module, and next the first and second color lights are reflected to divert by the reflector to emit in the same direction. Therefore, the beam collimated light emitting module with the light color mixed chamber of the present invention can improve the uniformity of the light color and the beam collimation simultaneously.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
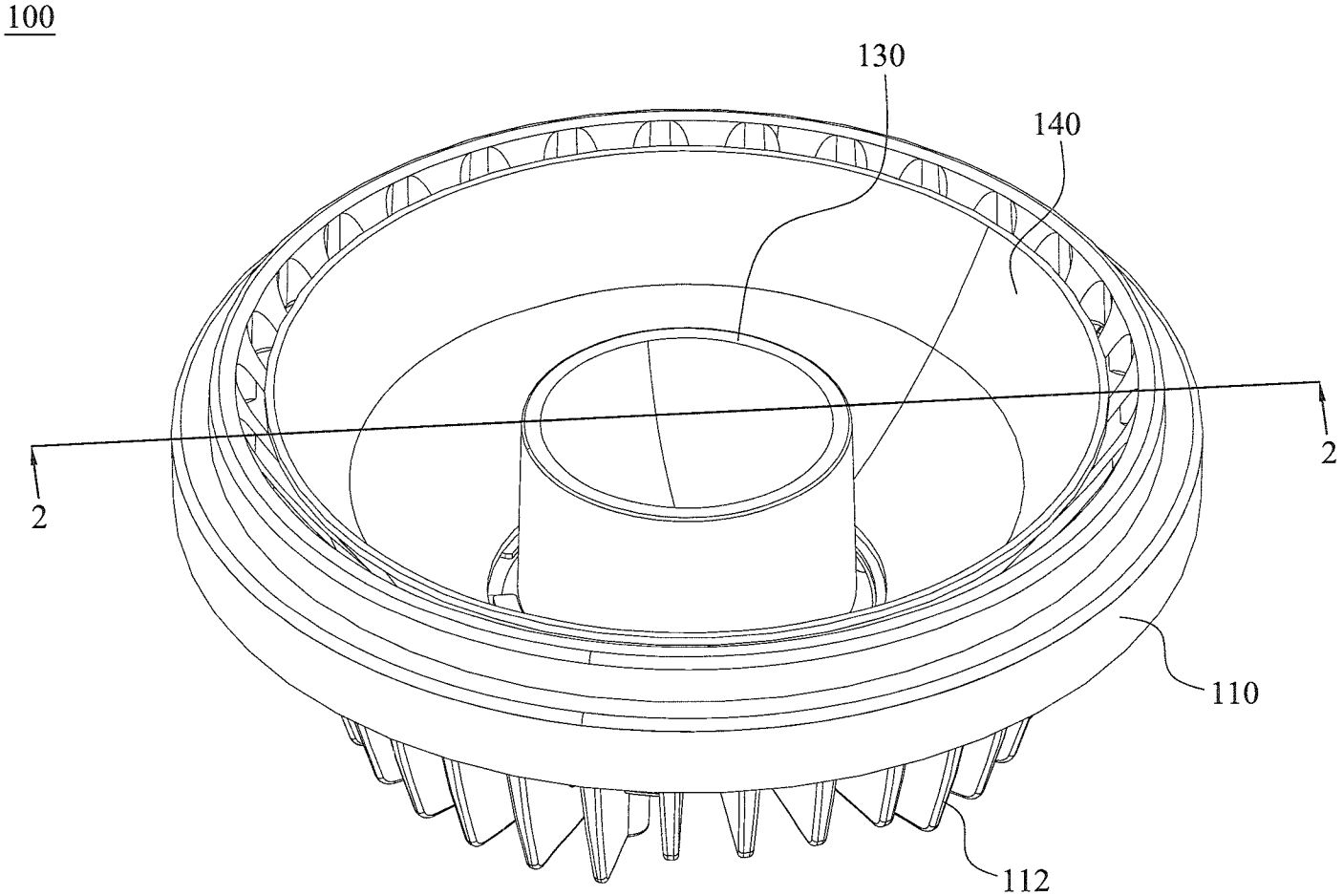
FIG. 1 is a perspective view of a beam collimated light emitting module with a light color mixed chamber according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

In the following description, "beam collimation" may be referred to as the concentration level of the light emitted by the light emitting module. That is to say, "beam collimation" is the capability of generating the light emitted in the same direction.

Moreover, "uniformity of the light color" means that the light color mixed level of the first color light (e.g., a bluish white light) adjacent to the center area and the second color light (e.g., a yellowish white light) adjacent to the surrounding area that are emitted by the LED light source assembly in the light emitting module when the light emitting module emits light.

Figure 2:
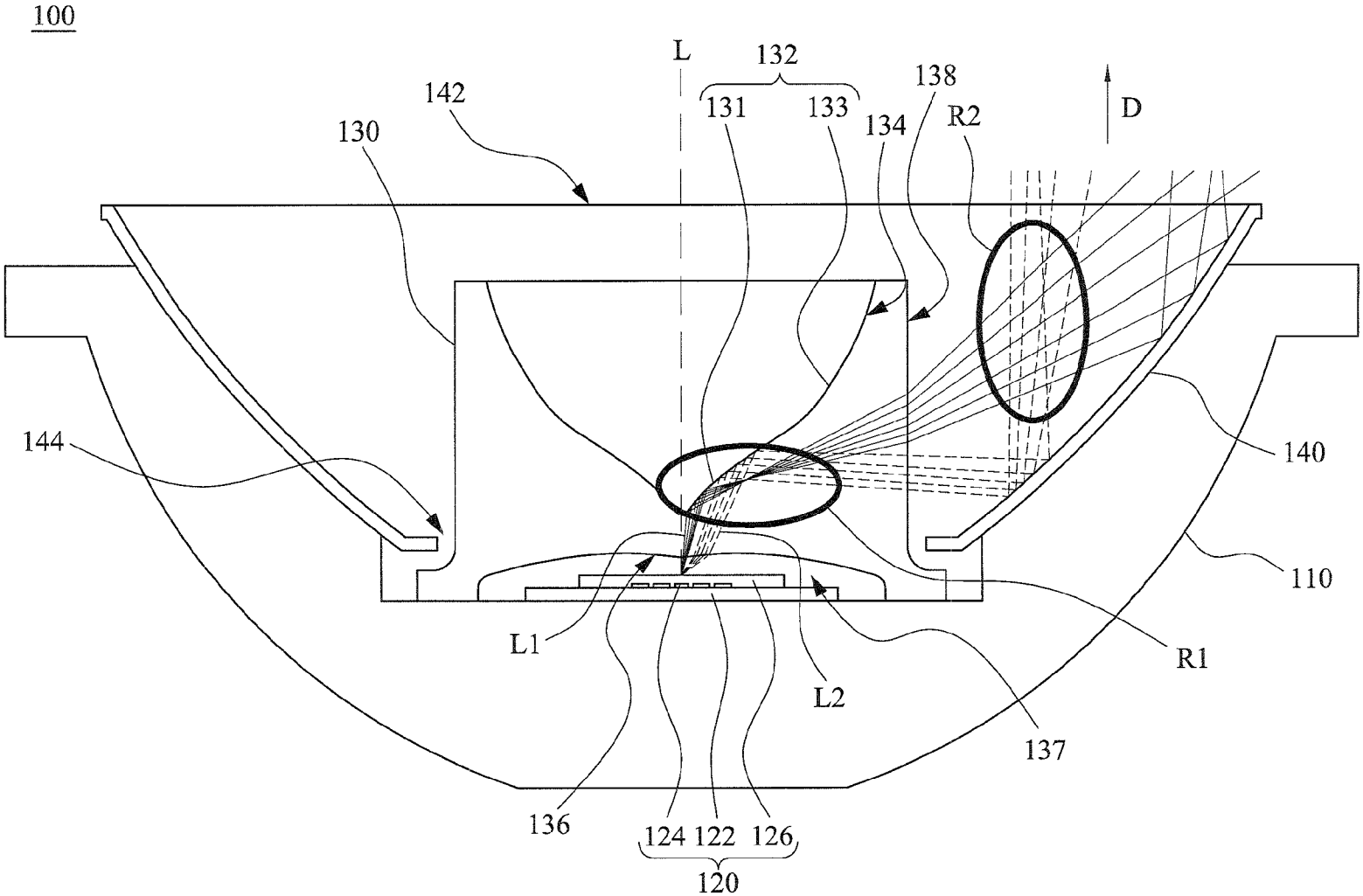
FIG. 2 is a cross-sectional view of the light emitting module taken along line 2-2 shown in FIG. 1.

FIG. 1 is a perspective view of a beam collimated light emitting module 100 with a light color mixed chamber according to an embodiment of the present invention. FIG. 2 is a cross-sectional view of the light emitting module 100 taken along line 2-2 shown in FIG. 1. As shown in FIG. 1 and FIG. 2, the light emitting module 100 includes a light holder 110, a light source assembly 120, an optical lens 130, and a reflector 140. The light source assembly 120 is located on the light holder 110. The optical lens 130 covers the light source assembly 120. The optical lens 130 includes a first light exit surface 134, a light entrance surface 136, and a second light exit surface 138. A round-shaped concave surface 132 is formed by recessing the first light exit surface 134, and the aspheric curvature of the concave surface 132 is gradually decreased in an outward direction away from the center of the optical lens 130. The concave surface 132 may be referred to as a total internal reflection (TIR) surface. The concave surface 132 may include plural concave surfaces with aspheric curvatures, and the number of the concave surfaces does not limit the present invention. For example, in this embodiment, the concave surface 132 has a first curved surface 131 with a first aspheric curvature and a second curved surface 133 with a second aspheric curvature, and an end of the first curved surface 131 is connected to an end of the second curved surface 133. The first and second aspheric curvatures are gradually decreased in an outward direction away from the center of the optical lens 130.

A round-shaped accommodating space 137 is formed by recessing the light entrance surface 136 for accommodating the light source assembly 120. The second light exit surface 138 is a side surface located between the first light exit surface 134 and the light entrance surface 136. An end of the side surface 138 is connected to the first light exit surface 134, and another end of the side surface 138 is connected to the light entrance surface 136. Moreover, the light entrance surface 136 is recessed toward the first light exit surface 134, and the first light exit surface 134 is recessed toward the light entrance surface 136.

The optical lens 130 may be made of a material that includes glass or plastic, but the present invention is not limited in this regard. The reflector 140 surrounds the optical lens 130. The reflector 140 is a hollow structure having a first opening 142 and a second opening 144. The caliber of the first opening 142 is greater than the caliber of the second opening 144. The optical lens 130 passes through the second opening 144 of the reflector 140.

The light source assembly 120 may be a light emitting diode (LED) or an organic light emitting diode. The light source assembly 120 may be electrically connected to an external power to provide current for chips 124. When the light source assembly 120 emits light, the light emitted by the light source assembly 120 can be refracted by the optical lens 130 and reflected by the reflector 140. Furthermore, the light holder 110 may has plural heat dissipation fins 112. The light holder 110 may be made of a material that includes metal, such as copper, aluminum, or iron. When the light source assembly 120 emits light, the light holder 110 may transfer heat to the heat dissipation fins 112 to reduce the temperature of the light source assembly 120.

In this embodiment, the light source assembly 120 includes blue lighting chips 124, packaging glue 126 with yellow phosphor powders, and a substrate 122. The packaging glue 126 may be made of a material that includes epoxy resin. The packaging glue 126 with yellow phosphor powders covers the blue lighting chips 124. Therefore, when the blue lighting chips 124 emit light, the light adjacent to the center area of the light source assembly 120 excited by the blue lighting chips 124 and the packaging glue 126 is a bluish white light, and the light adjacent to the surrounding area of the light source assembly 120 is a yellowish white light due to the weaker blue light. As a result, the light source assembly 120 may emit a first color light L1 and a second color light L2 surrounding the first color light L1. The first color light L1 is the bluish white light emitted by the center area of the light source assembly 120, and the second color light L2 is the yellowish white light emitted by the surrounding area of the light source assembly 120. However, in another embodiment, the combination of the lighting chips 124 and the packaging glue 126 is not limited in the present invention. For example, the light source assembly 120 may utilize ultraviolet (UV) lighting chips 124 and packaging glue 126 with red, green, and blue phosphor powders, and the present invention is not limited in this regard. In addition, lighting chips 124 may selectively use red, green, and blue chips with single color as deemed necessary by designers.

It is to be noted that the first and second color lights L1, L2 only mean that the color variation from the center area of the light source assembly 120 to the surrounding area of the light source assembly 120 may be substantially recognized the bluish white light and the yellowish white light. Practically, the color variation in an outward direction away from the center of the light source assembly 120 is gradually changed.

It is to be noted that the connection relationships and the materials of the elements described above will not be repeated in the following description. In the following description, the light emitted by the lighting chip 124 that is aligned with the axis L of the optical lens 130 will be described as an example.

After the light source assembly 120 emits the first and second color lights L1, L2, the concave surface 132 of the optical lens 130 refracts the first color light L1 (e.g., a bluish white light) and the second color light L2 (e.g., a yellowish white light) to a first time light-mixed position R1 by the design of the concave surface 132, such that the first and second color lights L1, L2 are mixed at the first time. After the first and second color lights L1, L2 are mixed at the first time, the first and second color lights L1, L2 are close to white lights. In this embodiment, the first time light-mixed position R1 of the first and second color lights L1, L2 is in the optical lens 130. Thereafter, the second color light L2 refracted by the concave surface 132 may be reflected to divert in the same direction by the reflector 140, and the first color light L1 may be refracted to a second time light-mixed position R2 by the design of the aspheric curvature of the concave surface 132, such that the second color light L2 reflected by the reflector 140 and the first color light L1 refracted by the concave surface 132 are mixed at the second time. After the first and second color lights L1, L2 are mixed at the second time, the first and second color lights L1, L2 can be assured to be more close to white lights. However, the light-mixed time of the first and second color lights L1, L2 is not limited to two times, and the present invention is not limited in this regard.

In this embodiment, the second time light-mixed position R2 of the first and second color lights L1, L2 is between the optical lens 130 and the reflector 140. The area surrounded by the reflector 140 may be regarded as the light color mixed chamber of the light emitting module 100.

Figure 3:
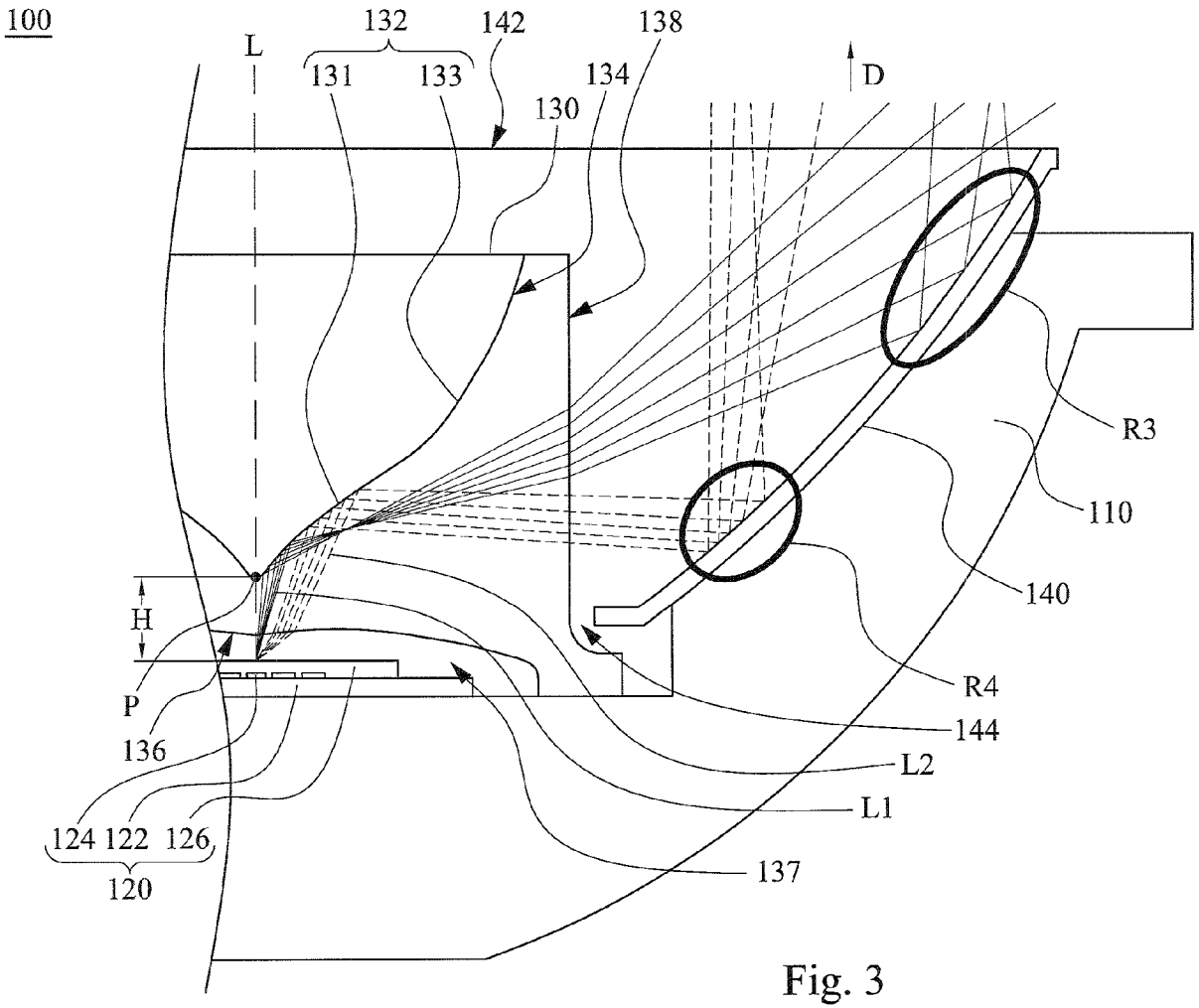
FIG. 3 is a partial enlarged view of the light emitting module shown in FIG. 2.

FIG. 3 is a partial enlarged view of the light emitting module 100 shown in FIG. 2. As shown in FIG. 2 and FIG. 3, since the first aspheric curvature of the first cured surface 131 of the concave surface 132 and the second aspheric curvature of the second cured surface 133 of the concave surface 132 are gradually decreased in an outward direction away from the center of the optical lens 130, and the second color light L2 surrounds the first color light L1, the aspheric curvature of the concave surface 132 refracting the first color light L1 is greater than the aspheric curvature of the concave surface 132 refracting the second color light L2. After the first color light L1 is refracted by the concave surface 132, the first color light L1 can be reflected by the first reflecting position R3 of the reflector 140. After the second color light L2 is refracted by the concave surface 132, the second color light L2 can be reflected by the second reflecting position R4 of the reflector 140. A distance between the first reflecting position R3 and the axis L of the optical lens 130 is greater than a distance between the second reflecting position R4 and the axis L of the optical lens 130. That is to say, the second reflecting position R4 of the optical lens 130 is more close to the optical lens 130 than the first reflecting position R3.

After the first and second color lights L1, L2 are both reflected by the reflector 140, the first and second color lights L1, L2 may divert to emit in the same direction D. Therefore, the beam collimation of the light emitting module 100 may be improved. The first and second color lights L1, L2 have been mixed at the first time in the optical lens 130, and the first and second color lights L1, L2 are further mixed at the second time between the optical lens 130 and the reflector 140. Therefore, when the first and second color lights L1, L2 emit in the same direction D, the first and second color lights L1, L2 have been mixed to uniform white lights, such that the uniformity of the light color of the light emitting module 100 may be improved. The beam collimated light emitting module 100 with the light color mixed chamber of the present invention utilizes the collocation design of the optical lens 130 and the reflector 140 to mix the first and second color lights L1, L2 at plural times in the light emitting module 100, and next the first and second color lights L1, L2 are reflected to divert by the reflector 140 to emit in the same direction D. Therefore, the light emitting module 100 can improve the uniformity of the light color and the beam collimation simultaneously.

Furthermore, the concave surface 132 of the optical lens 130 has an end point P. The end point P is located at the axis L of the optical lens 130 and faces the light source assembly 120, and a gap H is between the end point P and the light source assembly 120. As a result, the light emitting position of the light source assembly 120 can be lifted up to the end point P, such that the beam collimation of the light emitting module 100 may be further improved, and the volume of the whole light emitting module 100 may be reduced to save the space and the cost. For example, the volume of the reflector 140 may be reduced.

In addition, since the light emitting module 100 of an optical system can divert the light at the concave surface 132 of the first light exit surface 134 by the capability of the central optical lens 130, the light emitting surface of the light source assembly 120 adjacent to the bottom of the optical lens 130 is similarly lifted up in virtual to the first light exit surface 134 and emit light to the reflector 140. The design height of the first light exit surface 134 is equal to the height of the focus of the reflector 140, such that the light may be easily collimated, and the design size of the optical system may be significantly reduced. The aforesaid focus of the reflector 140 means that when a light source is located at a certain position in the reflector 140, the reflector 140 can divert all lights of the light source to emit outward in the same direction, and the position may be referred to as the focus of the reflector 140. The light emitting module 100 utilizes the combination of the light source assembly 120 and the optical lens 130 to lift up the light of the light source assembly 120 to the first light exit surface 134 of the optical lens 130 to emit light. That is to say, the light source is lifted up to the position of the focus of the reflector 140, such that the light may be prevented from being scattered and losing the energy of the light source.

Compared with the beam collimated light emitting module with the light color mixed chamber and a conventional lighting device, since the aspheric curvature of the concave surface is gradually decreased in the outward direction away from the center of the optical lens, when the light source assembly emits light, the first color light (e.g., a bluish white light) and the second color light (e.g., a yellowish white light) emitted by the light source assembly may be refracted to the reflector by the concave surface, such that the first and second color lights may be mixed at the first time. Thereafter, the second color light refracted by the concave surface may be reflected by the reflector, such that the second color light reflected by the reflector and the first color light refracted by the concave surface are mixed at the second time. That is to say, the light emitting module of the present invention utilizes the collocation design of the optical lens and the reflector to mix the first and second color lights at plural times in the light emitting module, and next the first and second color lights are reflected to divert by the reflector to emit in the same direction. Therefore, the uniformity of the light color and the beam collimation of the light emitting module may be improved simultaneously.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A beam collimated light emitting module with a light color mixed chamber, comprising:

a light holder;

a light source assembly located on the light holder; and an optical lens covering the light source assembly, comprising:

a first light exit surface, wherein a round-shaped concave surface is formed by recessing the first light exit surface, and an aspheric curvature of the concave surface is gradually decreased in an outward direction away from a center of the optical lens; wherein the concave surface has a first curved surface and a second curved surface that is adjacent to the first curved surface; the first curved surface has a first aspheric curvature, and the second curved surface has a second aspheric curvature, and the first and second aspheric curvatures are gradually decreased in the outward direction away from a center of the optical lens; and wherein a distance between the first curved surface and the light source assembly is smaller than a distance between the second curved surface and the light source assembly;

a light entrance surface, wherein a round-shaped accommodating space is formed by recessing the light entrance surface for accommodating the light source assembly; and a second light exit surface, wherein the second light exit surface is a side surface located between the first light exit surface and the light entrance surface, an end of the side surface is connected to the first light exit surface, and another end of the side surface is connected to the light entrance surface; and a reflector surrounding the optical lens, wherein the reflector is a hollow structure having a first opening and a second opening, a caliber of the first opening is greater than a caliber of the second opening, and the optical lens passes through the second opening of the reflector, wherein when the light source assembly emits light, the light source assembly emits a first color light and a second color light surrounding the first color light, the first and second color lights are refracted by the concave surface, such that the first and second color lights are mixed at a first time; and the second color light refracted by the concave surface is reflected by the reflector, such that the second color light reflected by the reflector and the first color light refracted by the concave surface are mixed at a second time.

2. The emitting module or claim 1, wherein the light source assembly is a light emitting diode or an organic light emitting diode.

3. The emitting module of claim 2, wherein the first color light is a bluish white light, and the second color light is a yellowish white light.

4. The emitting module of claim 1, wherein a first time light-mixed position of the first and second color lights is in the optical lens.

5. The emitting module of claim 4, wherein a second time light-mixed position of the first and second color lights is between the optical lens and the reflector.

6. The emitting module of claim 1, wherein the aspheric curvature of the concave surface refracting the first color light is greater than the aspheric curvature of the concave surface refracting the second color light.

7. The emitting module of claim 1, wherein the concave surface of the optical lens has an end point located at an axis of the optical lens and facing the light source assembly, and a gap is between the end point and the light source assembly.

8. The emitting module of claim 1, wherein the light entrance surface is recessed toward the first light exit surface, and the first light exit surface is recessed toward the light entrance surface.

9. The emitting module of claim 1, wherein the first color light refracted by the concave surface is reflected by a first reflecting position of the reflector, the second color light refracted by the concave surface is reflected by a second reflecting position of the reflector, and a distance between the first reflecting position and an axis of the optical lens is greater than a distance between the second reflecting position and an axis of the optical lens.

* * * * *